US006959557B2

(12) United States Patent
Manole et al.

(10) Patent No.: US 6,959,557 B2
(45) Date of Patent: Nov. 1, 2005

(54) APPARATUS FOR THE STORAGE AND CONTROLLED DELIVERY OF FLUIDS

(75) Inventors: Dan M. Manole, Tecumseh, MI (US); Alicia Frostick, Ann Arbor, MI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 10/653,502

(22) Filed: Sep. 2, 2003

(65) Prior Publication Data

US 2005/0044864 A1 Mar. 3, 2005

(51) Int. Cl.[7] ..... F25B 45/00; F25B 43/00; F25B 39/04

(52) U.S. Cl. ..... 62/149; 62/292; 62/509; 62/503

(58) Field of Search ..... 62/149, 292, 83, 62/502, 503, 509, 114, 115, 174, 119

(56) References Cited

U.S. PATENT DOCUMENTS

| | | | |
|---|---|---|---|
| 933,682 | A | 9/1909 | Voorhees |
| 1,408,453 | A | 3/1922 | Goosmann |
| 1,591,302 | A | 7/1926 | Franklin |
| 1,867,748 | A | 7/1932 | MacCabee |

(Continued)

FOREIGN PATENT DOCUMENTS

| | | |
|---|---|---|
| DE | 278095 | 6/1912 |
| DE | 1 021 868 | 1/1958 |
| DE | 24 01 120 | 7/1975 |
| DE | 26 04 043 | 8/1976 |
| DE | 26 60 122 | 1/1983 |
| DE | 11-63694 A | 6/1989 |
| EP | 0 174 027 | 9/1985 |
| EP | 0 604 417 | 4/1996 |
| EP | 0 617 782 | 5/1997 |
| EP | 0 424 474 | 11/1997 |
| EP | 0 672 233 | 11/1997 |
| EP | 1 043 550 | 10/2000 |
| GB | 1042975 | 9/1966 |
| JP | 2000-46420 | 2/1990 |
| JP | 2001-221517 | 8/2001 |
| NO | 146882 | 9/1982 |
| RU | SU 1521998 | 11/1989 |
| SE | 463 533 | 12/1990 |
| WO | WO 90/07683 | 9/1989 |

OTHER PUBLICATIONS

U.S. Patent Application filed Sep. 2, 2003 entitled "Multi-–Stage Vapor Compression System With Intermediate Pressure Vessel", Dan M. Manole, inventor.

Cooling Machinery and Apparatuses, GNTIMASH, Moscow, 1946, p. 56.

(Continued)

*Primary Examiner*—Chen Wen Jiang
(74) *Attorney, Agent, or Firm*—Baker & Daniels

(57) ABSTRACT

A vessel for containing a refrigerant fluid in a vapor compression system. The vessel includes a housing defining a fixed interior volume and an internal structure subdividing the interior volume into a storage chamber and a displacement chamber. The storage chamber is in fluid communication with the vapor compression system and stores both liquid phase and gas phase refrigerant during normal operation of the system. The displacement chamber may be repositionable or have a variable volume wherein varying the volume of the displacement chamber inversely varies the volume of the storage chamber. The volume of the displacement chamber may be controlled by the transfer of thermal energy to a working fluid within the displacement chamber to thereby thermally expand or contract the working fluid. By varying the volume of the storage chamber or the position of the displacement chamber therein, the mass of refrigerant stored therein may be controlled and, thus, the total refrigerant charge actively circulating in the vapor compression system may also be controlled.

30 Claims, 5 Drawing Sheets

U.S. PATENT DOCUMENTS

| | | | | |
|---|---|---|---|---|
| 1,976,079 | A | 10/1934 | Mallinckrodt | |
| 2,133,960 | A | 10/1938 | McCloy | |
| 2,219,815 | A | 10/1940 | Jones | 257/9 |
| 2,482,171 | A | 9/1949 | Gygax | 62/127 |
| 2,617,265 | A | 11/1952 | Ruff | 62/3 |
| 2,778,607 | A | 1/1957 | Quintilli | 257/24 |
| 2,901,894 | A | 9/1959 | Zearfoss, Jr. | 62/509 |
| 3,022,642 | A | 2/1962 | Long | |
| 3,234,738 | A | 2/1966 | Cook | 60/59 |
| 3,365,905 | A | 1/1968 | Barbier | 62/196 |
| 3,400,555 | A | 9/1968 | Granryd | 62/498 |
| 3,413,815 | A | 12/1968 | Granryd | 62/6 |
| 3,423,954 | A | 1/1969 | Harnish et al. | 62/222 |
| 3,513,663 | A | 5/1970 | Martin, Jr. et al. | 62/159 |
| 3,597,183 | A | 8/1971 | Murphy et al. | 62/114 |
| 3,638,446 | A | 2/1972 | Palmer | 62/202 |
| 3,828,567 | A | 8/1974 | Lesczynski | |
| 3,858,407 | A | 1/1975 | Schumacher | 62/217 |
| 3,872,682 | A | 3/1975 | Shook | 62/114 |
| 3,919,859 | A | 11/1975 | Ross | 62/503 |
| 4,009,596 | A | 3/1977 | Morse | |
| 4,019,679 | A | 4/1977 | Vogt et al. | 237/2 B |
| 4,048,814 | A | 9/1977 | Quack | 62/335 |
| 4,136,528 | A | 1/1979 | Vogel et al. | 62/174 |
| 4,182,136 | A | 1/1980 | Morse | |
| 4,205,532 | A | 6/1980 | Brenan | 62/115 |
| 4,439,996 | A | 4/1984 | Frohbieter | 62/174 |
| 4,631,926 | A | 12/1986 | Goldshtein et al. | 62/115 |
| 4,679,403 | A | 7/1987 | Yoshida et al. | 62/114 |
| 4,702,086 | A | 10/1987 | Nunn, Sr. et al. | 62/113 |
| 4,811,568 | A | 3/1989 | Horan et al. | 62/200 |
| 5,042,262 | A | 8/1991 | Gyger et al. | 62/64 |
| 5,062,274 | A | 11/1991 | Shaw | 62/117 |
| 5,086,324 | A | 2/1992 | Hagino | 62/99 |
| 5,142,884 | A | 9/1992 | Scaringe et al. | 62/324.4 |
| 5,167,128 | A | 12/1992 | Bottum | |
| 5,174,123 | A | 12/1992 | Erickson | 62/113 |
| 5,245,836 | A | 9/1993 | Lorentzen et al. | 62/174 |
| 5,394,709 | A | 3/1995 | Lorentzen | 62/402 |
| 5,431,026 | A | 7/1995 | Jaster | 62/221 |
| 5,497,631 | A | 3/1996 | Lorentzen et al. | |
| 5,611,211 | A * | 3/1997 | Whipple, III | 62/149 |
| 5,655,378 | A | 8/1997 | Pettersen | 62/174 |
| 5,685,160 | A | 11/1997 | Abersfelder et al. | 62/114 |
| 5,692,389 | A | 12/1997 | Lord et al. | 62/222 |
| 5,829,262 | A | 11/1998 | Urata et al. | 62/174 |
| 6,042,342 | A | 3/2000 | Orian | |
| 6,044,655 | A | 4/2000 | Ozaki et al. | 62/205 |
| 6,073,454 | A | 6/2000 | Spauschus et al. | 62/114 |
| 6,085,544 | A | 7/2000 | Sonnekalb et al. | 62/498 |
| 6,105,386 | A | 8/2000 | Kuroda et al. | 62/513 |
| 6,112,532 | A | 9/2000 | Bakken | 62/174 |
| 6,112,547 | A | 9/2000 | Spauschus et al. | 62/476 |
| 6,182,456 | B1 | 2/2001 | Yamaguchi et al. | 62/222 |
| 6,185,955 | B1 | 2/2001 | Yamamoto | 62/470 |
| 6,250,099 | B1 | 6/2001 | Furuya et al. | 62/473 |
| 6,298,674 | B1 | 10/2001 | Finkenberger et al. | 62/115 |
| 6,343,486 | B1 | 2/2002 | Mizukami | 62/509 |
| 6,349,564 | B1 | 2/2002 | Lingelbach et al. | 62/510 |
| 6,385,980 | B1 | 5/2002 | Sienel | 62/174 |
| 6,385,981 | B1 | 5/2002 | Vaisman | 62/196.3 |
| 6,418,735 | B1 | 7/2002 | Sienel | 62/115 |
| 6,460,358 | B1 | 10/2002 | Hebert | 62/225 |
| 2002/0050143 | A1 | 5/2002 | Watanabe et al. | 62/204 |

OTHER PUBLICATIONS

Kalteprozesse Dargestellt Mit Hilfe Der Entropietafel, by Dipl.–Ing. Prof. P. Ostertag, Berlin, Verlag Von Julius Springer, 1933 (with translation).

Patent Abstracts of Japan, vol.. 13, No. 489, M888, abstract of JP 01–193561, publ. Aug. 3, 1989.

Principles of Refrigeration, by W.B. Gosney; Cambridge University Press, 1982.

Refrigeration Engineering, by H.J. MacIntire, Refrigerants and Properties of Vapors, pp. 60–61, 1937.

* cited by examiner

APPARATUS FOR THE STORAGE AND CONTROLLED DELIVERY OF FLUIDS

BACKGROUND OF THE INVENTION

1. Field of the Invention

The present invention relates to vapor compression systems, more particularly, to a vessel disposed within such a system for containing refrigerant and having a variable storage volume.

2. Description of the Related Art

Refrigeration systems typically include, in series, a compressor, a condenser, an expansion device, and an evaporator. In operation, gas phase refrigerant is drawn into the compressor where it is compressed to a high pressure. The high pressure refrigerant is then cooled and condensed to a liquid phase in the condenser. The pressure of the liquid phase refrigerant is then reduced by the expansion device. In the evaporator the low pressure liquid phase refrigerant absorbs heat and converts the low pressure liquid phase refrigerant back to a gas. The gas phase refrigerant then returns to the compressor and the cycle is repeated.

Compressors are typically designed for the compression of gas phase refrigerant, however, it is possible for a certain amount of liquid phase refrigerant to flow from the evaporator toward the compressor. For instance, when the system shuts down condensed refrigerant may be drawn into the compressor from the evaporator, thereby flooding the compressor with liquid phase refrigerant. When the system is restarted, the liquid phase refrigerant within the compressor can cause abnormally high pressures within the compressor and can thereby result in damage to the compressor. To prevent this phenomenon from occurring, it is known to use suction accumulators in the refrigeration system in the suction line of the compressor.

Commonly used suction accumulators are mounted near the suction inlet of the compressor and separate liquid and gas phase refrigerant. As the refrigerant flows into the accumulator, the liquid phase refrigerant collects at the bottom of the storage vessel, while the gas phase refrigerant flows through the storage vessel to the compressor. Typically, a metered orifice is provided in the lower portion of the vessel to dispense a small amount of the collected liquid phase refrigerant to the compressor, thereby preventing large amounts of potentially harmful liquid phase refrigerant from entering the compressor.

Similar vessels for separating liquid and gas phase refrigerant may also be located on the discharge side of the compressor. When located on the discharge side of the compressor, such vessels are typically referred to as receivers. Examples of known suction accumulators are disclosed in U.S. Pat. Nos. 4,009,596 and 4,182,136 assigned to Tecumseh Products Company and which are hereby expressly incorporated herein by reference.

SUMMARY OF THE INVENTION

The present invention provides a vessel for containing a refrigerant fluid in a vapor compression system wherein the storage volume or configuration of the vessel can be varied to thereby vary the total charge of refrigerant being circulated in the vapor compression system. The interior volume of the vessel includes both a displacement chamber and a storage chamber and the storage volume, defined by the storage chamber, available within the vessel to receive refrigerant fluid is controlled by varying the volume and/or position of the displacement chamber.

The present invention comprises, in one form thereof, a vessel for containing a refrigerant fluid in a vapor compression system wherein the vessel includes a housing defining a fixed interior volume and an internal structure. The internal structure is disposed within the housing and subdivides the interior volume. The interior volume defines a storage chamber defining a volume for containing refrigerant fluid and a displacement chamber. The storage chamber is in fluid communication with the vapor compression system and contains both liquid phase refrigerant fluid and gas phase refrigerant fluid during normal operation of the vapor compression system. The displacement chamber has a selectively variable volume wherein varying the volume of the displacement chamber inversely varies the volume of said storage chamber, i.e., an increase in the displacement chamber volume causes a decrease in the storage chamber volume and a decrease in the displacement chamber volume causes an increase in the storage chamber volume. The vessel housing also defines an inlet port through which refrigerant fluid is communicated into the storage chamber and an outlet port through which refrigerant fluid is communicated out of the storage chamber. The internal structure is positionable at least partially below the outlet port and varying the volume of the displacement chamber at least partially varies the volume of the storage chamber below the outlet port.

The internal structure may define an enclosure for a working fluid wherein varying the volume of the working fluid selectively varies the volume of said displacement chamber. The vessel may also include a thermal exchange element for exchanging thermal energy with the working fluid to thereby vary the volume of the working fluid. The thermal exchange element may take a variety of forms, e.g., it may be a heat pipe, a heating element or it may conveys a second working fluid for exchanging thermal energy with the working fluid. Alternatively, the working fluid within the enclosure may be thermally coupled with an external thermal reservoir, e.g., a heat source formed by a compressor or a heat sink formed by a portion of the low pressure region of the vapor compression system.

The working fluid and the refrigerant fluid may be the same fluid wherein the working fluid is gas phase refrigerant and the vessel includes a thermal exchange element and the enclosure defines an opening proximate the bottom of the enclosure and positioned below an upper surface of liquid phase refrigerant fluid contained within the storage chamber.

In some embodiments, the enclosure fully encloses the working fluid and is at least partially flexible or elastic. In other embodiments, the enclosure fully encloses the working fluid and includes a fixed enclosure housing and a moveable barrier sealingly engaged with the enclosure housing wherein movement of the barrier relative to the enclosure housing varies the volume of the displacement chamber.

The present invention comprises, in another form thereof, a vessel for containing a refrigerant fluid in a vapor compression system. The vessel includes a vessel housing defining a fixed interior volume and an internal structure disposed within the housing and subdividing the interior volume wherein the interior volume defines a storage chamber defining a volume for containing refrigerant fluid and a displacement chamber. The storage chamber is in fluid communication with the vapor compression system and contains both liquid phase refrigerant fluid and gas phase refrigerant fluid during normal operation of the vapor compression system. The vessel housing defines an inlet port through which refrigerant fluid is communicated into the storage chamber and an outlet port through which refrigerant fluid is communicated out of the storage chamber. The internal structure is repositionable within the vessel housing and repositioning of the internal structure varies the volume of the displacement chamber disposed below the outlet port. The displacement chamber may have a substantially constant volume.

The present invention comprises, in another form thereof, a vapor compression system for use with a refrigerant fluid which includes a compressor, a first heat exchanger, an expansion device and a second heat exchanger fluidly connected in serial order to thereby define a vapor compression circuit and a vessel. The vessel has a housing defining a fixed interior volume and an internal structure disposed within the housing and subdividing the interior volume. The interior volume defines a storage chamber defining a volume for containing refrigerant fluid and a displacement chamber. The storage chamber is in fluid communication with the vapor compression circuit and contains both liquid phase refrigerant fluid and gas phase refrigerant fluid during normal operation of the vapor compression system. The displacement chamber has a selectively variable volume wherein varying the volume of the displacement chamber inversely varies the volume of the storage chamber.

The present invention comprises, in yet another form thereof, a method of regulating the charge of refrigerant circulating in a vapor compression system. The method includes providing a vessel having a housing defining a substantially fixed interior volume, subdividing the interior volume into a storage chamber and a displacement chamber, and providing fluid communication between the storage chamber and the vapor compression system. The method also includes storing both liquid phase and gas phase refrigerant fluid in the storage chamber during normal operation of the vapor compression system and selectively varying the volume of the storage chamber by controlling the volume of the displacement chamber whereby the volume of refrigerant contained within the housing is selectively variable.

The volume of the displacement chamber may be controlled by controlling the temperature of a working fluid within the displacement chamber and the working fluid may be contained within an enclosure that fully encloses the working fluid. The method may employ a vessel housing that defines an inlet port through which refrigerant fluid is communicated into the storage chamber and an outlet port through which refrigerant fluid is communicated out of the storage chamber wherein the outlet port is positioned below the inlet port and varying the volume of the displacement chamber at least partially varies the volume of the storage chamber below the outlet port and the method further includes discharging liquid phase refrigerant fluid through the outlet port by increasing the volume of the discharge chamber. The storage chamber may be placed in fluid communication with the vapor compression system between an evaporator and a compressor and with the method further including separating liquid phase refrigerant fluid from gas phase refrigerant fluid within the storage chamber.

BRIEF DESCRIPTION OF THE DRAWINGS

The above-mentioned and other features and objects of this invention, and the manner of attaining them, will become more apparent and the invention itself will be better understood by reference to the following description of embodiments of the invention taken in conjunction with the accompanying drawings, wherein.

The embodiments hereinafter disclosed are not intended to be exhaustive or limit the invention to the precise forms disclosed in the following description. Rather the embodiments are chosen and described so that others skilled in the art may utilize its teachings.

DETAILED DESCRIPTION

Figure 2:
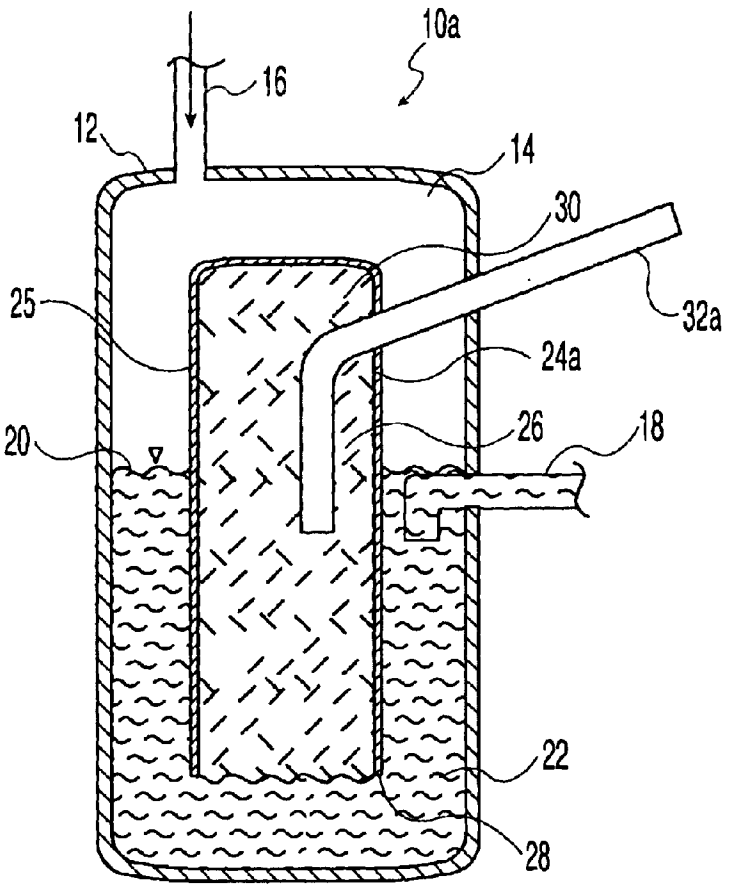
FIG. 2 is another schematic side view of the vessel of FIG. 1.
Figure 1:
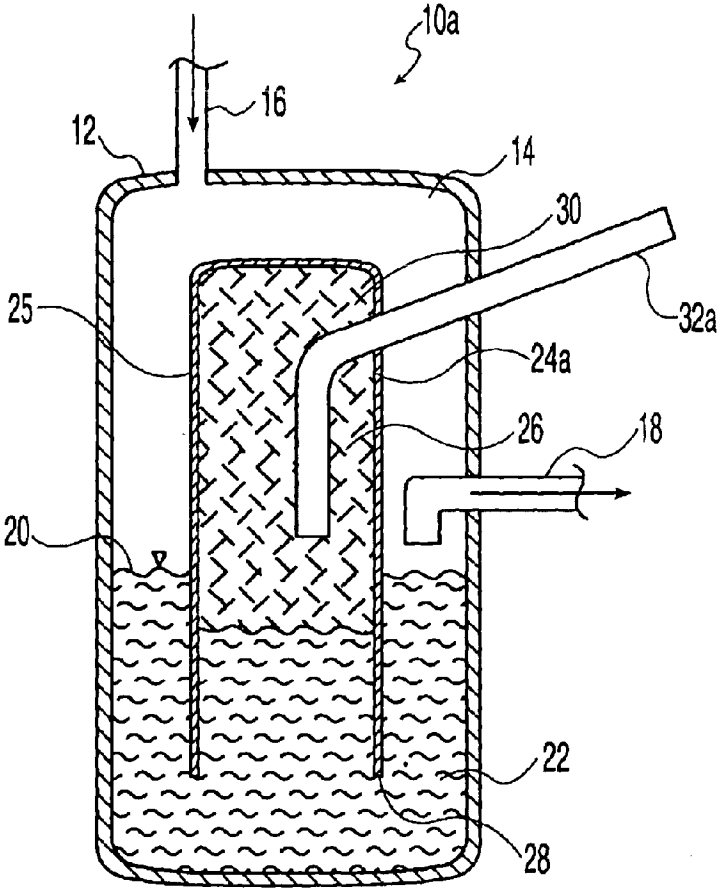
FIG. 1 is a schematic side view of a vessel according to one embodiment of the present invention.

Vessels 10 in accordance with the present invention are illustrated in the Figures and several embodiments, i.e., vessels 10*a*–10*d*, of the novel vessel are illustrated and discussed below. With reference to FIGS. 1 and 2, vessel 10*a* includes housing 12 which defines an interior volume having a storage chamber 14 and an internal structure 24*a* defining a displacement chamber. Inlet tube 16 extends through the wall of housing 12 and communicates with an upper portion of storage chamber 14 and thereby defines an inlet port in housing 12. Inlet 16 is in fluid communication with a vapor compression system, e.g., a refrigeration system, and communicates refrigerant 20 from the system to chamber 14. Refrigerant 20 is received within storage chamber 14 with the liquid phase refrigerant separating from the gas phase refrigerant and migrating to the lower portion 22 of storage chamber 14. As is explained in further detail below, the volume of storage chamber 14 is variable to thereby control the mass of refrigerant 20 that is stored within chamber 14. Outlet tube 18 extends through the wall of housing 12 and defines an outlet port in housing 12. Outlet 18 provides fluid communication between storage chamber 14 and the refrigeration system, with refrigerant fluid being communicated from storage chamber 14 to the system through outlet 18.

Figure 9:
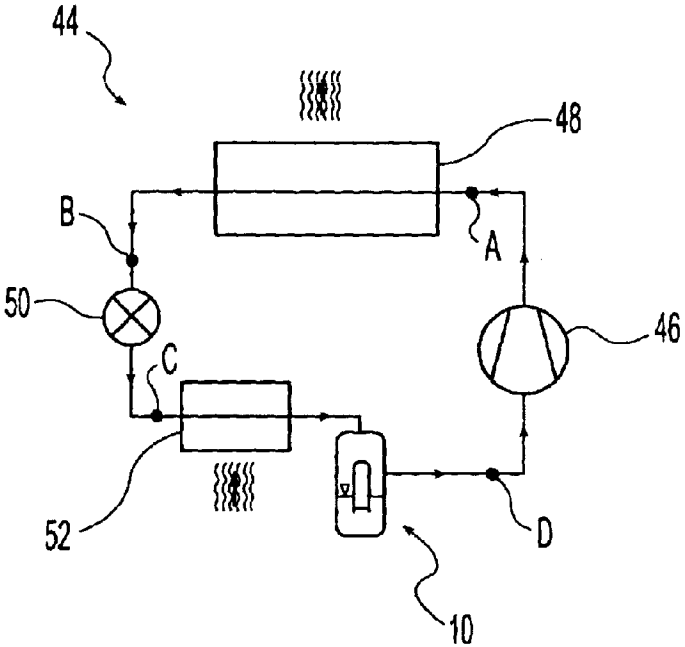
FIG. 9 is a schematic view of a vapor compression system including a vessel having a variable storage volume.

A vapor compression system 44 is illustrated in FIG. 9 and includes a compressor 46, a first heat exchanger 48, i.e., a condenser, an expansion device 50 and a second heat exchanger 52, i.e., an evaporator. A vessel 10 is located between evaporator 52 and compressor 46. During normal operation, refrigerant fluid 20 enters storage chamber 14 through inlet 16. Liquid phase refrigerant then settles in the lower portion 22 of storage chamber 14. Gas phase refrigerant is communicated from storage chamber 14 to the system through outlet 18. By variably controlling the mass of refrigerant contained within vessel 10, the total charge of refrigerant actively circulating within the system can also be controlled. For example, as the load placed on the refrigeration system changes, it may be desirable to change the total charge of refrigerant actively circulating within the system. Generally, increasing the refrigerant charge will increase the capacity of the system and vessel 10 can be used to increase the refrigerant charge actively circulating in the system when a large load is placed on the system and an increase in capacity is desired. When the system is no longer experiencing a peak load demand, vessel 10 can be used to store a higher mass of refrigerant thereby reducing the total charge of the system. This allows the refrigeration system to be configured so that under normal load conditions the system operates relatively efficiently with a first refrigerant charge and when a higher load is placed on the system, the refrigerant charge may be temporarily increased. After the load on the system has returned to normal levels, the refrigerant charge may also be returned to normal levels. Increasing the refrigerant charge of a refrigeration system will typically increase the power requirements of the system and, thus, providing a vessel 10 that may controllably vary the refrigerant charge of the system facilitates the efficient operation of the system by allowing the system to operate using a first refrigerant charge during normal operating conditions and a second larger charge only when the system is experiencing a peak load.

Several embodiments of a vessel 10 having a variable storage volume are illustrated in the Figures. The illustrated vessels include a housing 12 defining a fixed interior volume that is subdivided into a storage chamber 14 and a displacement chamber 24 wherein an increase in the volume of the displacement chamber results in a decrease in the volume of the storage chamber. Similarly, a decrease in the volume of the displacement chamber results in an increase in the volume of the storage chamber. The storage chamber 14 is in fluid communication with the vapor compression system 44 and by varying the volume of the storage chamber 14, the mass of refrigerant contained within vessel 10 can also be varied.

With reference to a first embodiment 10*a* of the vessel illustrated in FIGS. 1 and 2, displacement chamber 24*a* is disposed within the interior volume of vessel housing 12 and includes a rigid enclosure 25 defining a substantially vapor impermeable chamber volume 26. Displacement chamber 24*a* is open at its lower end 28, such that variable chamber volume 26 communicates with storage chamber 14 and refrigerant located in the lower portion 22 of storage chamber 14 may enter the displacement chamber structure 24*a* through lower end 28. A volume of working fluid 30 is contained within displacement chamber 24*a* and defines chamber volume 26. Thermal transfer element 32*a* is in thermal communication with working fluid 30 and the thermal expansion and contraction of working fluid 30 is controlled to thereby control the displacement volume 26.

As schematically illustrated, liquid phase refrigerant is contained in the lower portion 22 of the storage chamber 14 and gas phase refrigerant is contained in the upper portion of the storage chamber 14. FIG. 1 illustrates vessel 10*a* wherein the upper level 20 of the liquid phase refrigerant is located below outlet 18. Increasing the displacement volume 26 occupied by working fluid 30 reduces the volume of storage chamber 14 and displaces liquid phase refrigerant causing upper liquid level 20 to rise within storage chamber 14. Refrigerant continues to enter storage chamber 14 as the volume of the storage chamber 14 decreases, however, due to the decreased volume of storage chamber 14 a net outflow of refrigerant occurs. At first, the upper level 20 of the liquid phase refrigerant is below outlet 18 and only gas phase refrigerant is communicated from storage chamber 14 through outlet 18. While this results in a net decrease in the mass of refrigerant contained within storage chamber 14, once the upper level of liquid level 20 reaches outlet 18 resulting in the outflow of liquid phase refrigerant, as depicted in FIG. 2, the rate at which the mass of refrigerant within storage chamber 14 is communicated to vapor compression system 44 greatly increases. The increase in displacement volume 26 may be accomplished by transferring thermal energy to working fluid 30. If this is accompanied by an increased temperature within storage chamber 14, it may result in the evaporation of some of the liquid phase refrigerant contained within chamber 14 which will also result in a decrease in the mass of refrigerant contained within storage chamber 14.

Similarly, a decrease in the displacement volume 26 increases the volume of storage chamber 14 available to contain refrigerant and, depending upon the location of outlet 18, increases the volume of storage chamber 14 that is available to store liquid phase refrigerant. The decrease in displacement volume 26 may, in some embodiments, also be accompanied by a decrease in the temperature within storage chamber 14 facilitating the condensation of refrigerant and the increase of refrigerant mass contained within storage chamber 14.

The vessel 10 may be operated whereby the default state of the working fluid 30, and displacement volume 26, is in a relatively contracted state and heat is selectively added to working fluid 30 to expand displacement volume 26. Alternatively, the default state of working fluid 30, and displacement volume 26, may be in a relatively expanded state and working fluid 30 is selectively cooled to reduce displacement volume 26, or, some combination of actively heating and cooling working fluid 30 may be employed.

The various illustrated embodiments of vessel 10 will now be discussed. In the embodiment 10*a* illustrated in FIGS. 1 and 2, liquid phase refrigerant is allowed to enter and occupy the lower portion of displacement chamber 24*a* through open end 28 as displacement volume 26 expands and contracts. The liquid phase refrigerant fluid contained in storage chamber 14 is in direct contact with working fluid 30 and by using gas phase refrigerant as working fluid 30, potential contamination or degradation of the refrigerant by working fluid 30 can be avoided. In this embodiment, the thermal transfer element 32*a* is a heat pipe. Heat pipes are widely available and consist of a sealed enclosure, e.g., a sealed aluminum or copper pipe, a working fluid contained within the pipe and a wick or capillary structure also located within the sealed pipe. One end of the heat pipe functions as a condenser, expelling thermal energy and condensing the working fluid within the pipe, and the other end of the pipe functions as an evaporator, evaporating the working fluid and absorbing thermal energy, the capillary structure within the heat pipe facilitates the transport of the working fluid from the warm side of the pipe to the cool side of the pipe. Heat pipes provide an effective means of transferring heat between locations and to assist in the transfer of thermal energy between the heat pipe and its surroundings, enhanced heat transfer surfaces such as fins may be used with the heat pipe. One end of heat pipe 32*a* is located within displacement volume 26 and exchanges thermal energy with the working fluid 30 contained therein. The opposite end of heat pipe 32*a* extends outwardly from vessel housing 12. If heat pipe 32*a* is to be used to heat working fluid 30, the end of the heat pipe 32*a* that extends outwardly of vessel housing 12 may have an electrical heating element coupled thereto to provide for the selective heating of heat pipe 32*a* and, thus, the selective heating and thermal expansion of working fluid 30. Alternatively, the end of heat pipe 32*a* that extends outwardly of vessel housing 12 could have heat dissipating fins mounted thereon and a blower directed thereat and the selective actuation of the blower may provide for the selective cooling of working fluid 30. The outer end of heat pipe 32*a* may also be coupled to a thermal reservoir. For example it may be coupled to a heat source, such as a compressor, or a heat sink, such as an evaporator or other portion of the suction line of a vapor compression system.

Enclosure 25 may be formed out of various materials including plastic and metallic materials. By forming enclosure out of a plastic material, it may be provided with enhanced insulative properties in comparison to an enclosure formed out of a metallic material. Alternatively, enclosure 25 may be formed out of a metallic material and lined with an insulative material or structure such as a multilayer structure including a vacuum layer.

Figure 4:
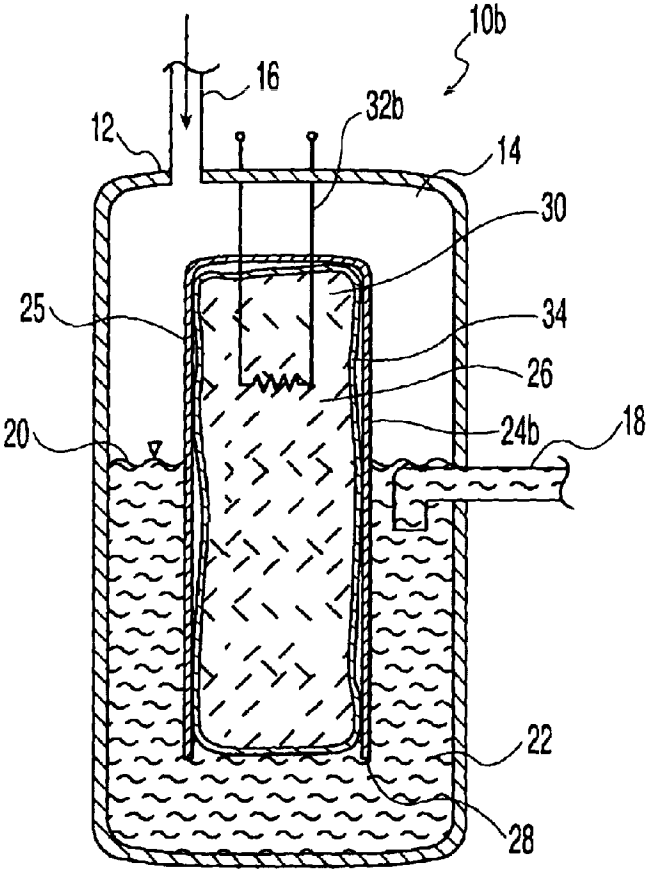
FIG. 4 is another schematic side view of the vessel of FIG. 3.
Figure 3:
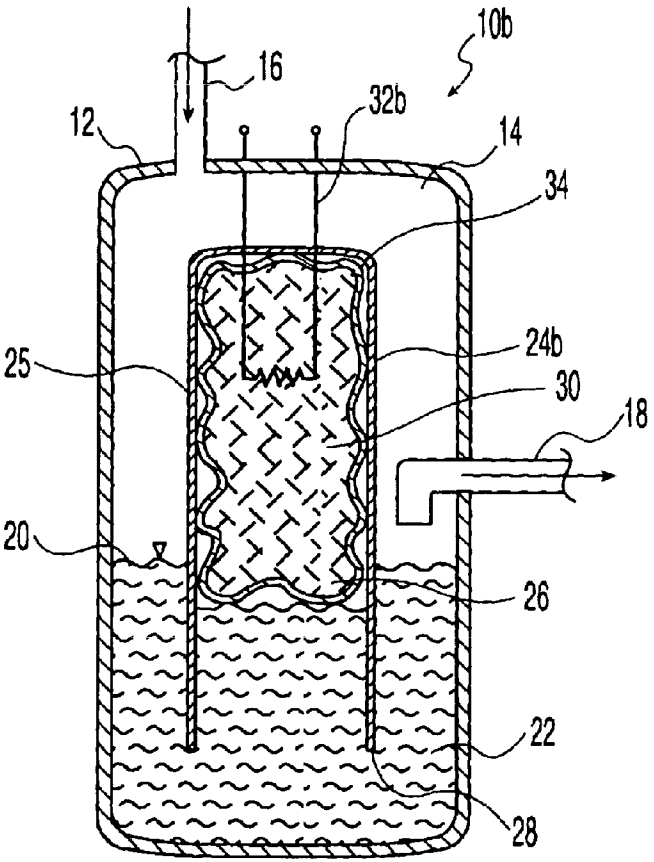
FIG. 3 is a schematic side view of a vessel according to another embodiment of the present invention.
Figure 6:
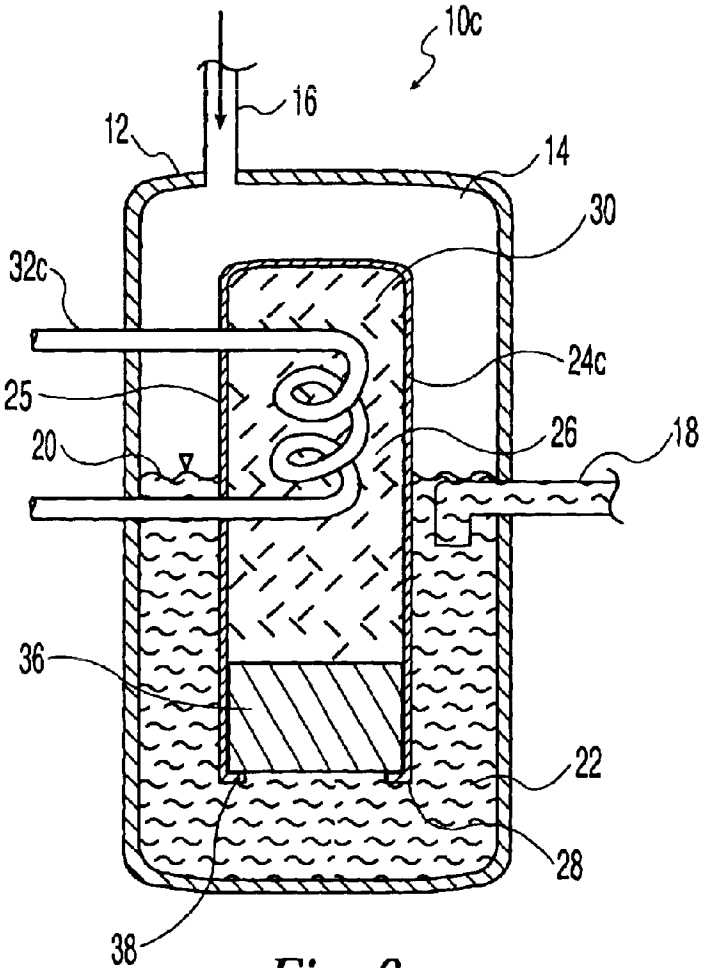
FIG. 6 is another schematic side view of the vessel of FIG. 5.

Vessel 10 may also include a means for physically separating working fluid 30 from the refrigerant contained within storage vessel 14. For instance, as shown in FIGS. 3 and 4, the working fluid 30 of vessel 10*b* is contained in an elastic bladder 34. Bladder 34 may be located within an enclosure 25 as illustrated, or, displacement chamber 24 may be formed by bladder 34 without the use of a rigid partial enclosure. Bladder 34 is capable of withstanding the expansion of working fluid 30 and may be made of any suitable elastically resilient material such as latex, elastic plastics, or rubber. In addition, rigid enclosure 25 and/or bladder 34 may be insulated, to inhibit the transfer of thermal energy between working fluid 30 and the refrigerant contained within storage chamber 14 to thereby inhibit the vaporization of liquid refrigerant contained within storage chamber 14 and/or condensation of working fluid 30. In illustrated embodiment 10*b*, the thermal exchange element 32*b* is an electrical heating element that can be used to selectively heat, and thus expand, working fluid 30.

Figure 5:
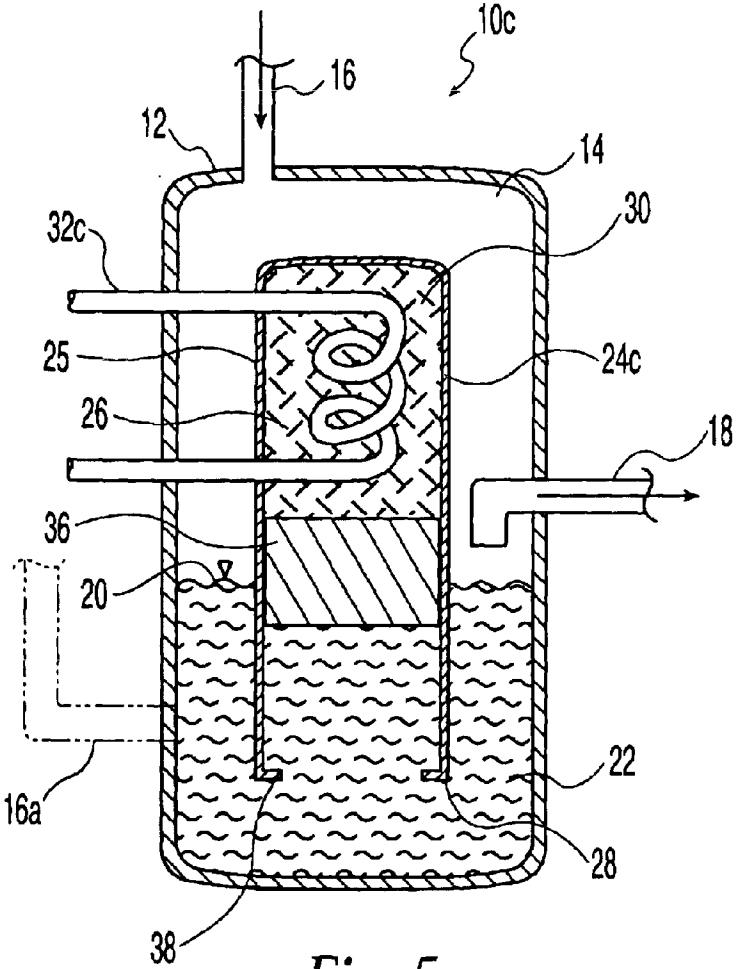
FIG. 5 is a schematic side view of a vessel according to another embodiment of the present invention.

Referring now to FIGS. 4 and 5, vessel 10*c* includes a barrier element 36, e.g., a piston, disposed within enclosure 25. Piston 36 physically separates working fluid 30 from the refrigerant contained within storage chamber 14. As working fluid 30 expands and contracts, it forces insulated piston 36 to translate within enclosure 25 between a relatively contracted position, shown in FIG. 4, to a relatively expanded position, shown in FIG. 5. Insulated piston 36 serves to separate liquid refrigerant 20 from working gas 30 and to inhibit the transfer of thermal energy from working fluid 30 to the refrigerant contained within storage chamber 14. In embodiment 10*c*, open end 28 of enclosure 25 may advantageously include a stop flange 38 to limit the translation of insulated piston 36.

Vessel 10*c* includes a thermal exchange element 32*c* that is formed by a fluid conduit that exchanges thermal energy with working fluid 30. Although, not shown, conduit 32*c* may include thermally conductive fins on its exterior surface within displacement volume 26. Conduit 32*c* may be used to either heat or cool working fluid 30. For example, by fluidly coupling the inlet of conduit 32*c* to vapor compression system 44 proximate point A and fluidly coupling the outlet of conduit 32*c* to vapor compression system 44 proximate point B, conduit 32*c* may be used to heat working fluid 30. Alternatively, by fluidly coupling the inlet of conduit 32*c* to vapor compression system 44 proximate point C and fluidly coupling the outlet of conduit 32*c* to vapor compression system 44 proximate point D, conduit 32*c* may be used to cool working fluid 30. By the use of one or more selectively actuated valves, fluid flow through conduit 32*c*, and the transfer of thermal energy between conduit 32*c* and working fluid 30, can be readily controlled.

Figure 8:
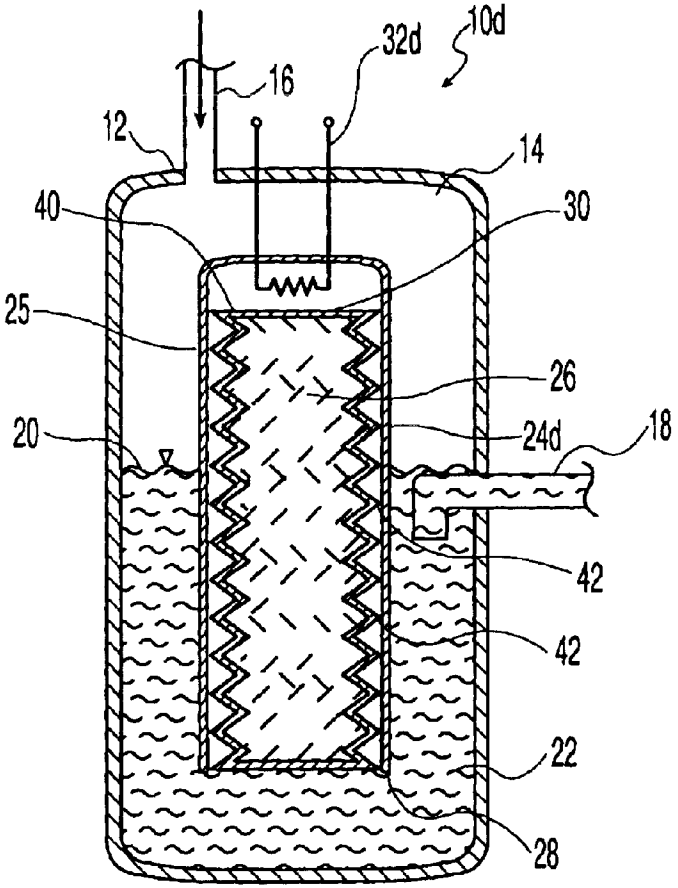
FIG. 8 is another schematic side view of the vessel of FIG. 7.
Figure 7:
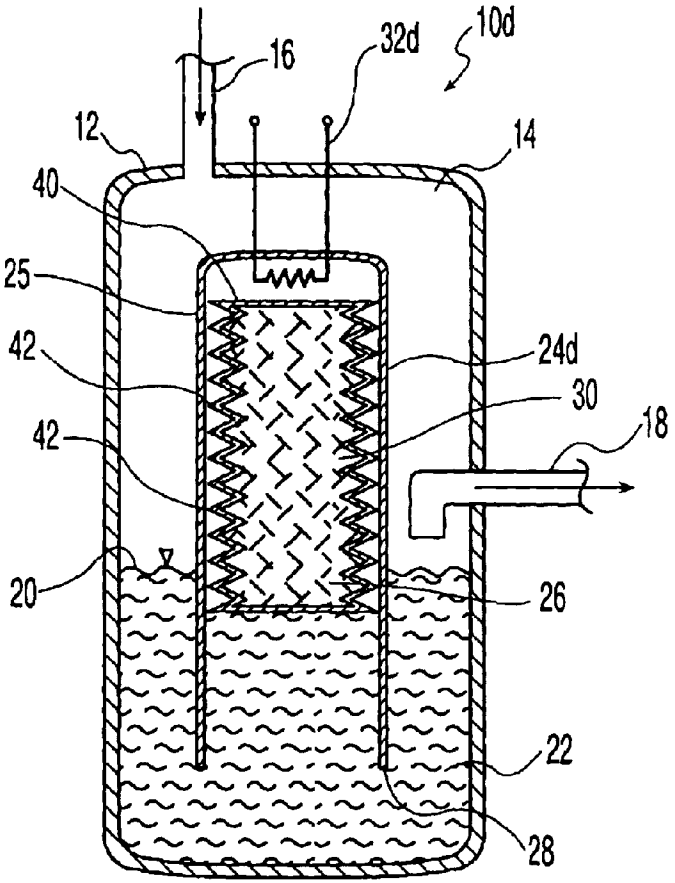
FIG. 7 is a schematic side view of a vessel according to another embodiment of the present invention.

Turning now to FIGS. 7 and 8, vessel 10*d* includes a flexible enclosure for working fluid 30, e.g., bellows 40, which is disposed within enclosure 25. Bellows 40 includes a wall defining an interior and including folds 42. Working fluid 30 is contained within the interior of bellows 40. Folds 42 of bellows 40 allow bellows 40 to expand, as shown in FIG. 8, and contract, as shown in FIG. 7, with the expansion and contraction of working fluid 30. An electrical heating element 32*d* is also provided in embodiment 10*d*. As shown, the heating element 32*d* is located between bellows 40 and enclosure 25. Utilizing an insulated enclosure 25 will inhibit the transfer of thermal energy from heating element 32*d* to refrigerant located within storage chamber 14.

Working fluid 30 may be any fluid capable of expanding and contracting in response to temperatures created by thermal exchange elements 32. More particularly, vessel 10 may be equipped with working fluids 30 having vaporization temperatures and properties corresponding to the thermal source used. It may also be advantageous to utilize the gas phase of the refrigerant contained within storage chamber 14 as working fluid 30 so that damage to the refrigeration system 44 is prevented in the event working fluid 30 is drawn into the refrigeration system. In each of the illustrated embodiments, the discharge chamber employs a gas phase working fluid 30, however, discharge chambers in accordance with the present invention are not limited to gas phase working fluids.

As discussed above, the thermal exchange element 32 may either heat or cool working fluid 30 and may be a heat pipe, an electric heating element, a heat exchanging conduit or a heat conducting element connected to a thermal reservoir.

The thermal exchange element 32 may provide for the continual transfer of thermal energy during operation of system 44. For example, it may continuously transfer heat to working fluid 30 to maintain working fluid 30 in a gas phase. A higher rate of transfer could then be employed to expand the volume of the working fluid. Alternatively, thermal exchange element 32 might only be used to exchange thermal energy with working fluid 30 when it is desirable to change the volume of working fluid 30.

In some applications it may also be advantageous to relocate the inlet port defined by inlet tube 16 to a position that is below the outlet port defined by outlet tube 18 as depicted by inlet tube 16*a* in FIG. 5. In such a configuration, the refrigerant entering the vessel may enter the vessel at a location below the surface level of the liquid phase refrigerant stored within the vessel. This will facilitate the transfer of thermal energy between the incoming refrigerant and the liquid phase refrigerant stored within the vessel and thereby tend to maintain the liquid phase refrigerant at a temperature near that of the incoming refrigerant. To prevent liquid phase refrigerant from migrating outside the vessel within inlet tube 16*a*, an inlet tube 16 which enters the vessel above outlet tube 18 could be extended within the vessel such that the inlet port defined by the inlet tube was positioned below the outlet port defined by outlet tube 18.

The volume range through which working fluid 30 is expanded and contracted may consist of only a minimum and maximum value or, with the relatively precise control of thermal exchange element 32 such as an electrical heating element, it may also be provide a range of displacement volume values between a minimum and maximum volume value. Temperature and pressure sensors may be placed at various locations in vapor compression system 44 and within displacement chamber 24. The output of the sensors may be received by an electronic controller to monitor the performance of system 44 and displacement chamber 24 and control the volume of storage chamber 14 by varying the temperature of displacement chamber 24 in response to changes in the load on system 44.

If desired, vessel 10 may also separate liquid phase refrigerant from gas phase refrigerant during normal operation of system 44. As shown in the plan view of FIG. 10, displacement chamber 24 may extend across the full width of vessel 10 with inlet 16 and outlet 18 being located on opposite sides of displacement chamber 24. This configuration forces gas phase refrigerant entering vessel 10 to migrate upwards over displacement chamber 24 before exiting vessel 10 through outlet 18. The liquid phase refrigerant entering vessel 10 through inlet 16 will have a tendency to migrate downward and collect in the bottom of vessel 10. Additional or alternative baffle structures to facilitate the separation of liquid phase refrigerant from the gas phase refrigerant may also be employed with vessel 10.

Figure 10:
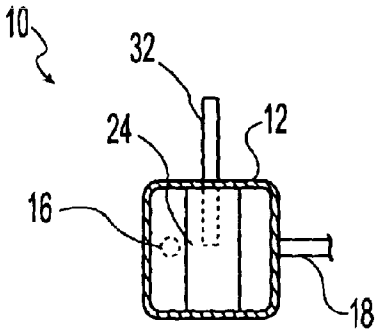
FIG. 10 is a schematic plan view of a vessel in accordance with the present invention.

As can also be seen in FIG. 10, by abutting at least one side of discharge chamber 24 with the interior surface of vessel housing 12, the thermal transfer element 32 may extend through vessel housing 12 directly into discharge chamber 24 without having to extend through storage chamber 14 thereby inhibiting the direct transfer of thermal energy between element 32 and storage chamber 14 and avoiding the need to insulate element 32 within storage chamber 14.

Although the illustrated embodiments of vessel 10*a*–10*d* each employ a thermal transfer element to alter the volume of the displacement chamber, alternative embodiments could employ other means of expanding and contracting the volume of the displacement chamber such as by forcing additional working fluid 30 into the displacement chamber to enlarge the displacement chamber volume and removing working fluid from the chamber to reduce the displacement chamber volume.

Figure 11:
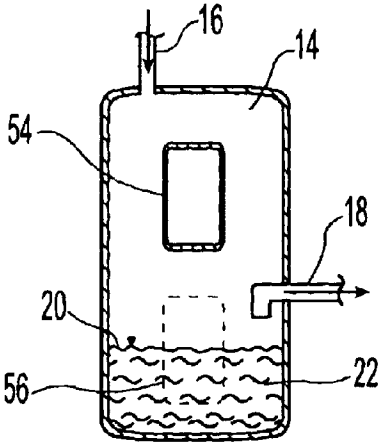
FIG. 11 is a schematic side view of a vessel according to another embodiment of the present invention.

A vessel 10*e* is shown in FIG. 11 that has a displacement chamber defined by enclosure 54. To alter the mass of refrigerant contained within vessel 10*e*, displacement chamber 54 does not change volume, e.g., a rigid enclosure, instead it is repositioned within vessel 10 as exemplified by dashed outline 56. By repositioning displacement chamber 54 so that a greater or lesser portion of the displacement chamber is below the outlet port defined by outlet tube 18. Although repositioning a constant volume displacement chamber within vessel 10*e* will not alter the volume of the storage chamber defined by vessel 10*e*, it will alter the volume within vessel 10*e* that can be used to store liquid phase refrigerant and thereby alter the mass of refrigerant stored within vessel 10*e*. A Bourdon tube may be secured to displacement chamber 54 to provide for the selective movement of displacement chamber 54. Bourdon tubes are well known and commonly found in pressure gauges. By varying the pressure supplied to the Bourdon tube, one end of the tube will be displaced. A relatively small change in the volume of the Bourdon tube may also result. Instead of using rigid displacement chamber 54, the Bourdon tube itself may alternatively act as the displacement chamber by appropriately positioning the Bourdon tube within the vessel so that the displacement of the Bourden tube caused by supplying different pressures to Bourden tube will alter the volume of the Bourden tube located below the outlet port defined by outlet tube 18.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A vessel for containing a refrigerant fluid in a vapor compression system, said vessel comprising:

a vessel housing defining a fixed interior volume;

an internal structure disposed within said housing and subdividing said interior volume wherein said interior volume defines a storage chamber defining a volume for containing refrigerant fluid and a displacement chamber, said displacement chamber positioned within said internal structure, said storage chamber being in fluid communication with the vapor compression system and containing both liquid phase refrigerant fluid and gas phase refrigerant fluid during normal operation of the vapor compression system, said displacement chamber having a variable volume wherein varying the volume of said displacement chamber inversely varies the volume of said storage chamber; and wherein said vessel housing defines an inlet port through which refrigerant fluid is communicated into said storage chamber and an outlet port through which refrigerant fluid is communicated out of said storage chamber, and said internal structure is positionable at least partially below said outlet port and varying the volume of said displacement chamber at least partially varies the volume of said storage chamber below said outlet port.

2. The vessel of claim 1 wherein said internal structure defines an enclosure for a working fluid and wherein varying the volume of said working fluid varies the volume of said displacement chamber.

3. The vessel of claim 2 further comprising a thermal exchange element for exchanging thermal energy with said working fluid and thereby varying the volume of said working fluid.

4. The vessel of claim 3 wherein said thermal exchange element is a heating element.

5. The vessel of claim 3 wherein said thermal exchange element conveys a second working fluid for exchanging thermal energy with said working fluid.

6. The vessel of claim 3 wherein said thermal exchange element is a heat pipe.

7. The vessel of claim 2 wherein said working fluid and the refrigerant fluid are the same fluid.

8. The vessel of claim 7 wherein said working fluid is gas phase refrigerant and said vessel further comprises a thermal exchange element for exchanging thermal energy with said working fluid and thereby varying the volume of said working fluid.

9. The vessel of claim 8 wherein said enclosure defines an opening proximate the bottom of said enclosure and positioned below an upper surface of liquid phase refrigerant fluid contained within said storage chamber.

10. The vessel of claim 2 wherein said enclosure fully encloses said working fluid and is at least partially flexible.

11. The vessel of claim 2 wherein said enclosure fully encloses said working fluid and is at least partially elastic.

12. The vessel of claim 2 wherein said enclosure fully encloses said working fluid and includes a fixed enclosure housing and a moveable barrier sealingly engaged with said enclosure housing wherein movement of said barrier relative to said enclosure housing varies the volume of said displacement chamber.

13. The vessel of claim 1 wherein said outlet port is positioned below said inlet port.

14. A vessel for containing a refrigerant fluid in a vapor compression system, said vessel comprising:

a vessel housing defining a fixed interior volume;

an internal structure disposed within said housing and subdividing said interior volume wherein said interior volume defines a storage chamber defining a volume for containing refrigerant fluid and a displacement chamber, said storage chamber disposed at least in part outside of said internal structure, said storage chamber being in fluid communication with the vapor compression system and containing both liquid phase refrigerant fluid and gas phase refrigerant fluid during normal operation of the vapor compression system; and wherein said vessel housing defines an inlet port through which refrigerant fluid is communicated into said storage chamber and an outlet port through which refrigerant fluid is communicated out of said storage chamber, and said internal structure is repositionable within said vessel housing and repositioning of said internal structure varies the volume of said displacement chamber disposed below said outlet port.

15. The vessel of claim 14 wherein said outlet port is positioned below said inlet port.

16. The vessel of claim 14 wherein said displacement chamber has a substantially constant volume.

17. A vapor compression system for use with a refrigerant fluid, said system comprising:

a compressor, a first heat exchanger, an expansion device and a second heat exchanger fluidly connected in serial order to thereby define a vapor compression circuit having a high pressure section and a low pressure section, said high pressure section disposed between said compressor and said expansion device and including said first heat exchanger, said low pressure section disposed between said expansion device and said compressor and including said second heat exchanger; and a vessel having a housing defining a fixed interior volume and an internal structure disposed within said housing and subdividing said interior volume wherein said interior volume defines a storage chamber defining a volume for containing refrigerant fluid and a displacement chamber, said storage chamber being in fluid communication with said low pressure section of said vapor compression circuit and containing both liquid phase refrigerant fluid and gas phase refrigerant fluid during normal operation of the vapor compression system, said displacement chamber having a selectively variable volume wherein varying the volume of said displacement chamber inversely varies the volume of said storage chamber.

18. The vapor compression system of claim 17 wherein said internal structure defines an enclosure for a working fluid and wherein selectively varying the volume of said working fluid selectively varies the volume of said displacement chamber.

19. The vapor compression system of claim 18 further comprising a thermal exchange element for exchanging thermal energy with said working fluid and thereby varying the volume of said working fluid.

20. The vapor compression system of claim 19 wherein said thermal exchange element is a heating element.

21. The vapor compression system of claim 19 wherein said thermal heat exchange element is in fluid communication with said vapor compression circuit and wherein said heat exchange element selectively conveys refrigerant fluid from said vapor compression circuit for exchanging thermal energy with said working fluid.

22. The vapor compression system of claim 21 wherein said thermal heat exchange element is in fluid communication with said vapor compression circuit between said compressor and said first heat exchanger whereby said thermal exchange element selectively heats said working fluid.

23. The vapor compression system of claim 21 wherein said thermal heat exchange element is in fluid communication with said vapor compression circuit between said expansion device and said compressor whereby said thermal exchange element selectively cools said working fluid.

24. The vapor compression system of claim 17 wherein said vessel housing defines an inlet port through which refrigerant fluid is communicated into said storage chamber and an outlet port through which refrigerant fluid is communicated out of said storage chamber, said outlet port being positioned below said inlet port and wherein said internal structure is disposed at least partially below said outlet port and varying the volume of said displacement chamber at least partially varies the volume of said storage chamber below said outlet port.

25. The vapor compression system of claim 17 wherein said storage chamber is in fluid communication with said vapor compression circuit at a location between said second heat exchanger and said compressor.

26. A method of regulating the charge of refrigerant circulating in a vapor compression system, said method comprising:

providing a vessel having a housing defining a substantially fixed interior volume;

subdividing the interior volume into a storage chamber and a displacement chamber by disposing an internal structure within the vessel, the displacement chamber disposed within the internal structure;

providing fluid communication between the storage chamber and the vapor compression system;

storing both liquid phase and gas phase refrigerant fluid in the storage chamber during normal operation of the vapor compression system;

selectively varying the volume of the storage chamber by controlling the volume of the displacement chamber whereby the volume of refrigerant contained within the housing is selectively variable.

27. The method of claim 26 wherein the volume of the displacement chamber is controlled by controlling the temperature of a working fluid within the displacement chamber.

28. The method of claim 27 wherein the working fluid is contained within an enclosure which fully encloses the working fluid.

29. The method of claim 26 wherein the vessel housing defines an inlet port through which refrigerant fluid is communicated into the storage chamber and an outlet port through which refrigerant fluid is communicated out of the storage chamber, the outlet port being positioned below the inlet port and varying the volume of the displacement chamber at least partially varies the volume of the storage chamber below the outlet port and the method further comprises discharging liquid phase refrigerant fluid through the outlet port by increasing the volume of the discharge chamber.

30. The method of claim 26 wherein the storage chamber is in fluid communication with the vapor compression system between an evaporator and a compressor and the method further comprises separating liquid phase refrigerant fluid from gas phase refrigerant fluid within the storage chamber.

* * * * *